US008827416B2

(12) United States Patent
Hayashi

(10) Patent No.: US 8,827,416 B2
(45) Date of Patent: Sep. 9, 2014

(54) PRINTING APPARATUS

(71) Applicant: Brother Kogyo Kabushiki Kaisha, Nagoya (JP)

(72) Inventor: Akihiro Hayashi, Komaki (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/852,529

(22) Filed: Mar. 28, 2013

(65) Prior Publication Data

US 2014/0078205 A1 Mar. 20, 2014

(30) Foreign Application Priority Data

Sep. 20, 2012 (JP) ..... 2012-207279

(51) Int. Cl.
*B41J 29/393* (2006.01)

(52) U.S. Cl.
USPC ..... 347/19

(58) Field of Classification Search
CPC .... B41J 11/003; B41J 11/0025; B41J 11/008; B41J 11/009; B41J 11/485; B41J 11/50; B41J 13/009
See application file for complete search history.

(56) References Cited

U.S. PATENT DOCUMENTS

| | | | | |
|---|---|---|---|---|
| 7,645,012 | B2 * | 1/2010 | Ikeda | 347/16 |
| 8,348,372 | B2 * | 1/2013 | Chikuma et al. | 347/14 |
| 8,511,781 | B2 * | 8/2013 | Yamamoto et al. | 347/16 |

FOREIGN PATENT DOCUMENTS

| | | |
|---|---|---|
| JP | H01-184156 A | 7/1989 |
| JP | H06-087237 A | 3/1994 |

* cited by examiner

*Primary Examiner* — Lamson Nguyen
(74) *Attorney, Agent, or Firm* — Merchant & Gould PC

(57) ABSTRACT

A printing apparatus includes: a data receiver; a printing device; a tray; and a controller. The controller identifies, based on the received print data, a sheet size of a sheet to be used for printing and detects a sheet size of a sheet placed on the tray. A storage device stores an identified type associated with the identified sheet size and a detected type associated with the detected sheet size. When the identified type and the detected type are identical, the controller reduces or enlarges a size of an image based on the received print data, on the basis of the detected sheet size, and controls the printing device to conduct printing of the image. When the identified type and the detected type are different, the controller restricts conduct of the printing.

16 Claims, 6 Drawing Sheets

FIG.2

12b

| 12b1 SHEET SIZE | 12b2 SHEET TYPE | 12b3 TRAY | 12b4 INK | 12b5 DUPLEX PRINTING |
|---|---|---|---|---|
| A3 | PLAIN PAPER | RECORDING-SHEET TRAY | PIGMENT INK | POSSIBLE |
| JIS B4 | | | | |
| A4 | | | | |
| Letter | | | | |
| Legal | | | | |
| Exective | | | | |
| JIS B5 | | | | |
| A5 | | | | |
| A6 | GLOSSY PAPER | PHOTO TRAY | DYE INK | IMPOSSIBLE |
| L | | | | |
| 2L | | | | |
| C5 | ENVELOPE | RECORDING-SHEET TRAY | PIGMENT INK | |
| No. 10 | | | | |
| DL | | | | |

FIG.5 FIRST EMBODIMENT
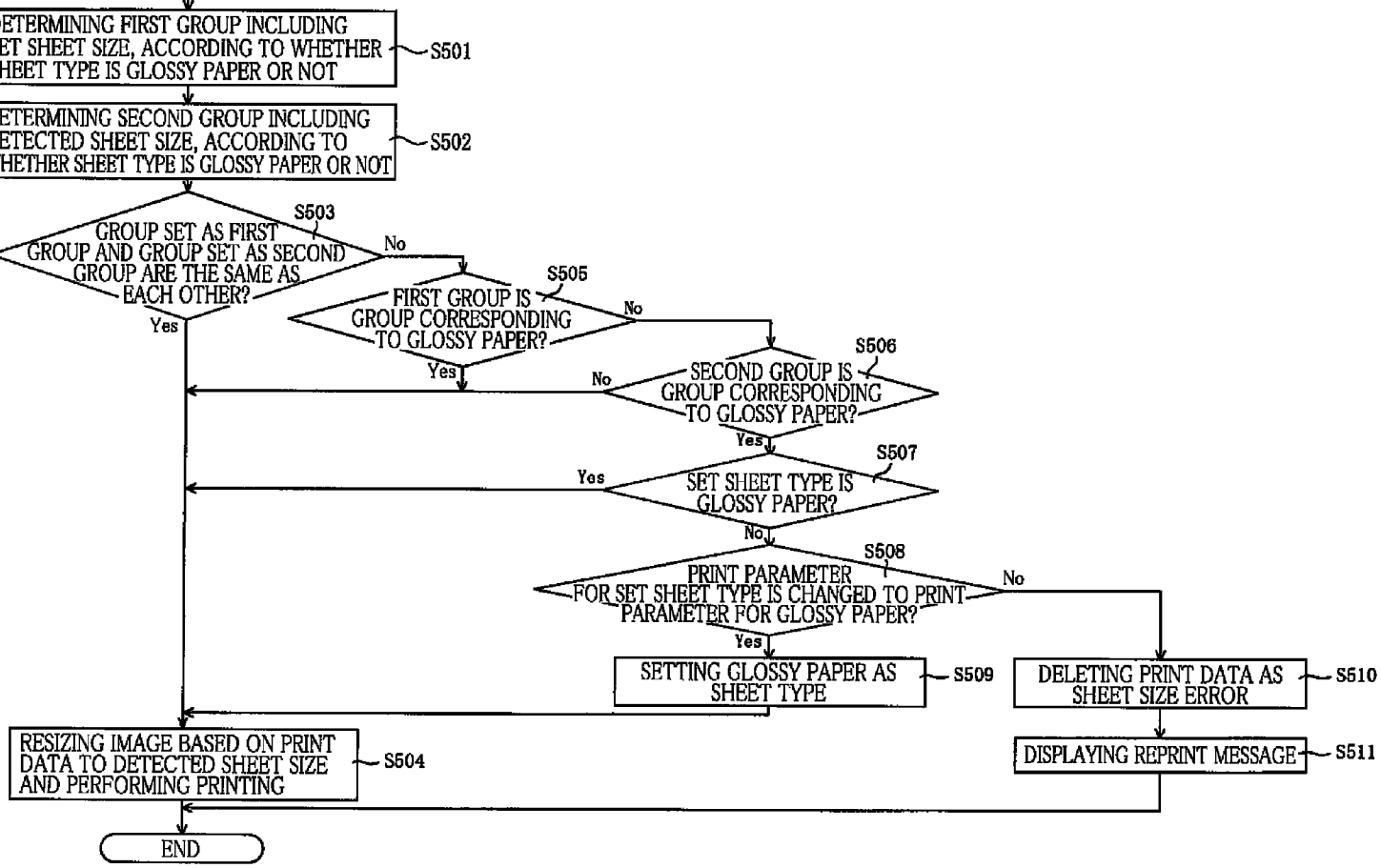

FIG.6 SECOND EMBODIMENT
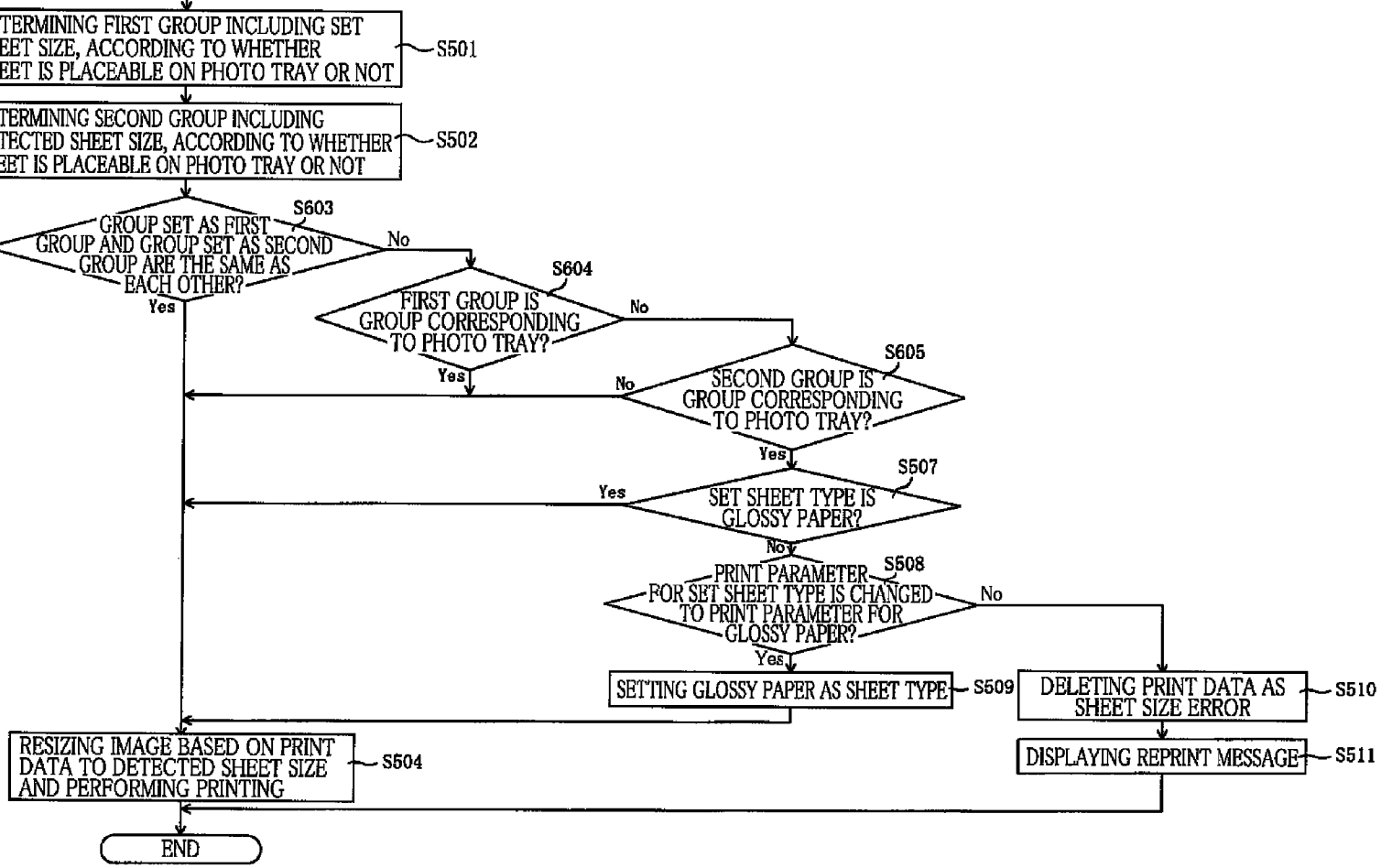

PRINTING APPARATUS

CROSS REFERENCE TO RELATED APPLICATION

The present application claims priority from Japanese Patent Application No. 2012-207279, which was filed on Sep. 20, 2012, the disclosure of which is herein incorporated by reference in its entirety.

BACKGROUND OF THE INVENTION

1. Field of the Invention

The present invention relates to a printing apparatus.

2. Description of the Related Art

There is conventionally known a technique of carrying out printing after a size of an image based on print data is reduced or enlarged so as to suit a size of a sheet actually mounted or placed in or on a printing apparatus. For example, there is known a technique of calculating a ratio of reduction or enlargement on the basis of: a sheet size based on print-type data contained in print data; and a size of a sheet actually mounted, to reduce or enlarge an image based on the print data at the calculated ratio.

SUMMARY OF THE INVENTION

The above-described technique allows the printing apparatus to resize the image based on the print data so as to fit within the sheet actually mounted and print the resized image on the sheet regardless of a sheet size set by the print data. In this technique, however, the resizing and printing are performed in all cases where the sheet size set by the print data and the sheet size of the sheet actually mounted are different from each other, raising a possibility of printing not intended by a user.

For example, in a case where the user has instructed printing on an A4-size plain paper sheet, if a sheet actually mounted is an L-size glossy paper sheet, a size of an image based on print data is reduced from the A4 size to the L size, and the reduced-size image is printed on the L-size glossy paper sheet. In general, pigment ink is used for printing set to be performed on the plain paper sheet. Thus, if the printing set to be performed on the plain paper sheet is performed on the glossy paper sheet, the pigment ink may not be fixed on the glossy paper sheet, causing a printed material to be soiled with the pigment ink. Also in a case where printing set to be performed on an envelope is performed on a plain paper sheet or a glossy paper sheet with size reduction or enlargement, this printing may produce a printed material not intended by the user, leading to useless printing.

This invention has been developed to provide a printing apparatus capable of preventing printing not intended by a user, in a case where a sheet size set by print data and a sheet size of a sheet to be used for printing are different from each other.

The present invention provides a printing apparatus, comprising: a receiver configured to receive print data from an information processor; a printing device configured to conduct printing on a sheet based on the print data received by the receiver; a tray configured to hold the sheet; a storage device configured to store each of a plurality of sheet sizes and a corresponding one type of a plurality of types in association with each other, the plurality of types comprising an identified type and a detected type; and a controller comprising: an identifier configured to identify, based on the print data received by the receiver, a sheet size of a sheet on which the printing device is to conduct the printing based on the print data; a detector configured to detect a sheet size of a sheet placed on the tray; a determiner configured to, when the sheet size identified by the identifier and the sheet size detected by the detector differ from each other, determine whether the identified type associated with the sheet size identified by the identifier and the detected type associated with the sheet size detected by the detector are identical to each other; and a printing controller configured to, when the determiner determines that the identified type and the detected type are identical to each other, one of reduce and enlarge a size of an image based on the print data received by the receiver, based on the sheet size detected by the detector, and control the printing device to conduct printing of the image whose size has been one of reduced and enlarged by the printing controller, the printing controller being configured to, when the determiner determines that the identified type and the detected type are different from each other, restrict conduct of the printing by the printing device based on the print data received by the receiver.

The present invention also provides a printing apparatus, comprising: a receiver configured to receive print data from an information processor; a printing device configured to conduct printing on a sheet based on the print data received by the receiver; a tray configured to hold the sheet; a storage device configured to store each of a plurality of sheet sizes and a corresponding one type of a plurality of types in association with each other, the plurality of types comprising an identified type, a detected type, a first type and a second type different from the first type; and a controller comprising: an identifier configured to identify, based on the print data received by the receiver, a sheet size of a sheet on which the printing device is to conduct the printing based on the print data; a detector configured to detect a sheet size of a sheet placed on the tray; a determiner configured to, when the sheet size identified by the identifier and the sheet size detected by the detector differ from each other, determine whether the identified type associated with the sheet size identified by the identifier and the detected type associated with the sheet size detected by the detector are identical to each other; and a printing controller configured to, when the determiner determines that the identified type and the detected type are different from each other, when the identified type is the second type, and when the detected type is the first type, one of reduce and enlarge a size of an image based on the print data received by the receiver, based on the sheet size detected by the detector, and control the printing device to conduct printing of the image whose size has been one of reduced and enlarged by the printing controller, the printing controller being configured to, when the determiner determines that the identified type and the detected type are different from each other, when the identified type is the first type, and when the detected type is the second type, restrict conduct of the printing by the printing device based on the print data received by the receiver.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIG. 2 is a schematic view illustrating a sheet-size table;

FIG. 5 is another flow chart illustrating the print control processing; and

FIG. 6 is a flow chart partly illustrating a print control processing in a second embodiment.

DETAILED DESCRIPTION OF THE EMBODIMENTS

Figure 1:
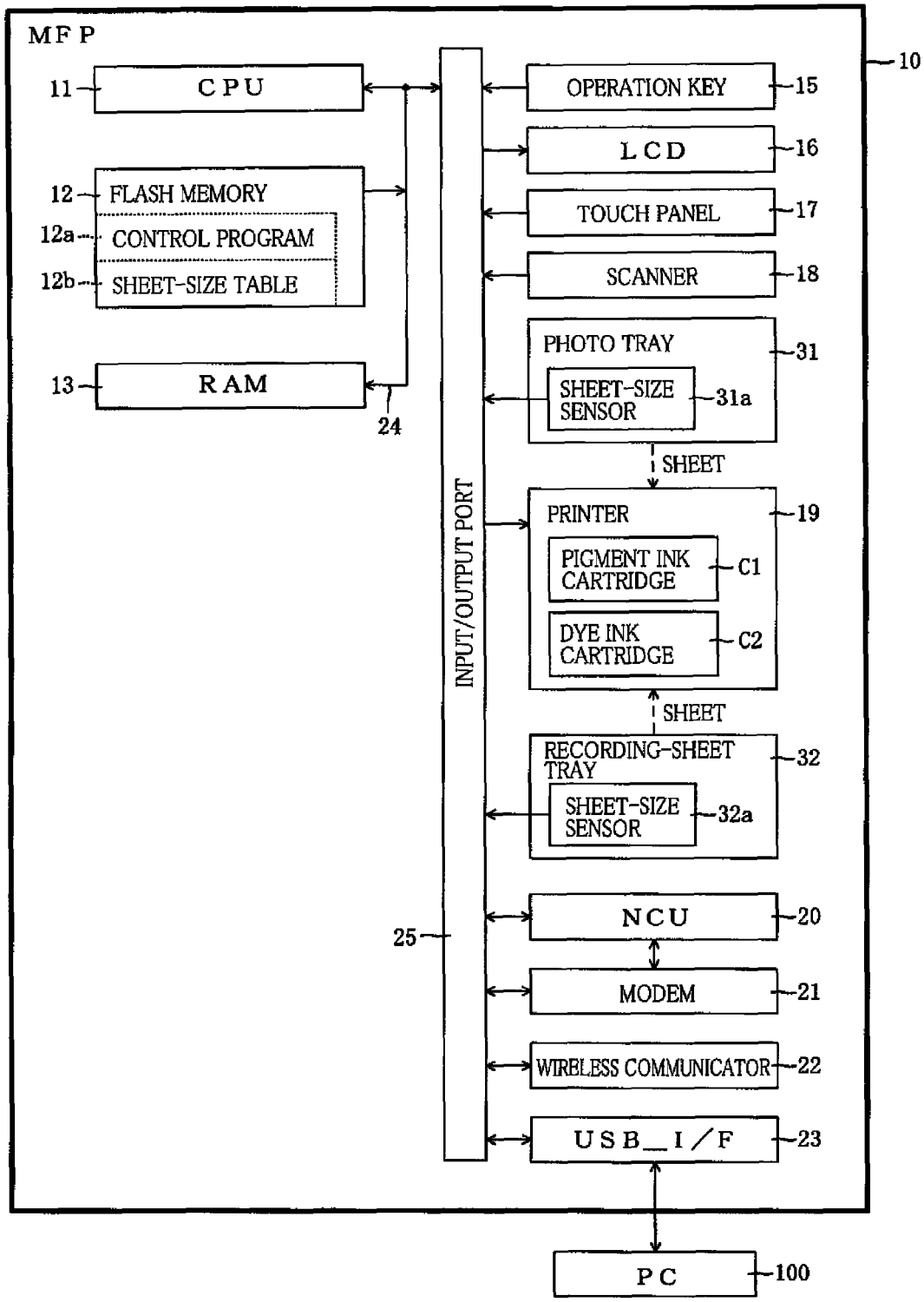
FIG. 1 is a block diagram illustrating an electric configuration of a multi-function peripheral (MFP)

Hereinafter, there will be described embodiments of the present invention by reference to the drawings. FIG. 1 illustrates an electric configuration of a multi-function peripheral (MFP) 10 as one example of a printing apparatus according to one embodiment of the present invention. The MFP 10 has various functions such as a printing function, a scanning function, and a facsimile function. In a case where a size of a sheet (i.e., a sheet size) set or designated by print data and a sheet size of a sheet to be used for printing differ from each other, the MFP 10 in the present embodiment is configured to, under specific conditions, resize an image based on the print data such that the image is fitted within the sheet to be used for printing (that is, such that an entire image is recorded on one sheet), and print the resized image on the sheet, but under other conditions, restrict or limit printing based on the print data to prevent printing not intended by a user.

The MFP 10 mainly includes a CPU 11, a flash memory 12, a RAM 13, operation keys 15, an LCD 16, a touch panel 17, a scanner 18, a printer 19, an NCU 20, a modem 21, a wireless communicator 22, and a USB interface (USB I/F) 23. The CPU 11, the flash memory 12, and the RAM 13 are connected to one another by a bus line 24. Also, the components 15-24 are connected to one another via an input/output port 25.

The CPU 11 controls the functions of the MFP 10 and the components connected to the input/output port 25, on the basis of fixed values and programs stored in the flash memory 12, data stored in the RAM 13, or various signals transmitted and received via the NCU 20. The flash memory 12 is a non-transitory memory configured to store information such as a control program 12*a* for controlling operations of the MFP 10. Processings in flow charts in FIGS. 3-5 (which will be described below) are executed by the CPU 11 according to the control program 12*a*. The flash memory 12 also stores a sheet-size table 12*b*. The sheet-size table 12*b* stores relationships between each of sheet sizes available in the MFP 10 and various characteristics of sheets such as a type of sheet (i.e., a sheet type), a tray to be used, ink to be used, and a suitability of duplex printing. It is noted that the sheet-size table 12*b* will be explained later in detail with reference to FIG. 2. The RAM 13 is a rewritable transitory memory having a temporary area for temporarily storing various data upon execution of the control program 12*a* by the CPU 11.

The operation keys 15 are mechanical keys each for receiving user's inputs of various set values and commands. The LCD 16 is a liquid crystal display. The touch panel 17 is overlaid on the LCD 16 to receive user's inputs of information such as set values and commands. The scanner 18 scans and reads a document to send the CPU 11 image data of the read document. The NCU 20 is a device configured to control a telephone line. The modem 21 modulates a transmission signal upon transmission of a facsimile and demodulates a received modulated signal upon receipt of a facsimile. The wireless communicator 22 is a device configured to perform wireless communication according to IEEE802.11b/g standards. The wireless communicator 22 is communicably connected to mobile terminals such as a smartphone. The USB I/F 23 is a well-known device for communicably coupling the MFP 10 to an external device such as a personal computer (PC) 100 by a USB cable.

The printer 19 is a device configured to print an image on a sheet. In the present embodiment, the printer 19 is an ink jet printer. The printer 19 includes a conveyor mechanism, not shown, and a print head, not shown. The conveyor mechanism conveys a sheet supplied from a Photo tray 31 or a recording-sheet tray 32. In this conveyance, the print head ejects ink stored in a pigment ink cartridge C1 or a dye ink cartridge C2 on the basis of print data received from the external device, to form an image on the sheet. It is noted that the printer 19 is capable of conducting or performing duplex printing in the present embodiment.

The Photo tray 31 is a tray for holding sheets for printing photographs such as a sheet of the L size. The recording-sheet tray 32 is a tray for holding recording sheets such as a sheet of the A4 size. In other words, the Photo tray 31 can hold sheets of first sheet sizes different from each other and each equal to or smaller than a predetermined sheet size, and the recording-sheet tray 32 can hold sheets of the first sheet sizes and second sheet sizes different from each other and each larger than the predetermined sheet size. Also, as will be described below, the recording-sheet tray 32 can also hold envelopes. The Photo tray 31 and the recording-sheet tray 32 are provided respectively with a sheet-size sensor 31*a* and a sheet-size sensor 32*a*. Each of the sheet-size sensors 31*a*, 32*a* detects a sheet size and outputs a signal related to a sheet size of a sheet placed on a corresponding one of the trays 31, 32, on the basis of a distance between a pair of sheet guides, not shown, provided on the corresponding one of the trays 31, 32. The CPU 11 can detect a sheet size of a sheet placed on each of the trays 31, 32, on the basis of the signal output from a corresponding one of the sheet-size sensors 31*a*, 32*a*.

The pigment ink cartridge C1 stores pigment ink of, e.g., a black color, and the dye ink cartridge C2 stores dye ink of various colors such as cyan, magenta, and yellow. The pigment ink cartridge C1 and the dye ink cartridge C2 are removably mounted on the printer 19.

There will be next explained the sheet-size table 12*b* with reference to FIG. 2. As illustrated in FIG. 2, a "SHEET TYPE" 12*b*2, a "TRAY" 12*b*3, an "INK" 12*b*4, and a "DUPLEX PRINTING" 12*b*5 are associated with a "SHEET SIZE" 12*b*1 in the sheet-size table 12*b*. The SHEET SIZE 12*b*1 includes the sheet sizes available in the MFP 10. In an example illustrated in FIG. 2, the SHEET SIZE 12*b*1 includes A3, JISB4, A4, Letter, Legal, Exective, JISB5, A5, A6, L, 2L, C5, No. 10, and DL. It is noted that each of the sheet sizes is identified on the basis of a length of a short side or a long side of a sheet detected by the sheet-size sensor 31*a* or 32*a*.

The SHEET TYPE 12*b*2 includes a plurality of sheet types or values, and each of the sheet sizes of the SHEET SIZE 12*b*1 corresponds to one of the sheet types. In the example illustrated in FIG. 2, information indicating that the sheet type is a plain paper (indicated by "PLAIN PAPER" in FIG. 2) is associated as the SHEET TYPE 12*b*2 with eight relatively large sizes of the SHEET SIZE 12*b*1 such as A4. Information indicating that the sheet type is a glossy paper (indicated by "GLOSSY PAPER" in FIG. 2) is associated as the SHEET TYPE 12*b*2 with three relatively small sizes of the SHEET SIZE 12*b*1 such as L. Information indicating that the sheet type is an envelope (indicated by "ENVELOPE" in FIG. 2) is associated as the SHEET TYPE 12*b*2 with three relatively envelope sizes of the SHEET SIZE 12*b*1 such as C5 (noted that each of the envelope sizes is a size unique to a corresponding one of envelopes). Accordingly, the sheet having each sheet size of the SHEET SIZE 12*b*1 can be classified as a corresponding one of the plain paper, the glossy paper, and the envelope on the basis of a value of the SHEET TYPE 12*b*2 which is associated with each sheet size of the SHEET SIZE 12*b*1.

The TRAY 12*b*3 includes a plurality of types (values) of trays to be used for printing, and each of the sheet sizes of the SHEET SIZE 12*b*1 corresponds to one of the trays, that is, the sheet having each of the sheet sizes is placed on a corresponding one of the trays. In the example illustrated in FIG. 2, information indicating that a sheet is to be placed on the recording-sheet tray 32 (indicated by "RECORDING-SHEET TRAY" in FIG. 2) as one example of a second placement type is associated as the TRAY 12*b*3 with the eight sheet sizes of the SHEET SIZE 12*b*1 such as A4. Likewise, the information indicating that a sheet is to be placed on the recording-sheet tray 32 is also associated as the TRAY 12*b*3 with the envelope sizes of the SHEET SIZE 12*b*1 such as C5. On the other hand, information indicating that a sheet is to be placed on the Photo tray 31 (indicated by "PHOTO TRAY" in FIG. 2) as one example of a first placement type is associated as the TRAY 12*b*3 with the three sheet sizes of the SHEET SIZE 12*b*1 such as L. Accordingly, the sheet having each sheet size of the SHEET SIZE 12*b*1 can be classified as a corresponding one of a sheet to be placed on the Photo tray 31 and a sheet to be placed on the recording-sheet tray 32 on the basis of a value of the TRAY 12*b*3 which is associated with each sheet size of the SHEET SIZE 12*b*1. That is, each sheet size of the SHEET SIZE 12*b*1 can be classified as one of placeable sizes and unplaceable sizes. Each of the placeable sizes is such a size that a sheet having this size is to be placed on the Photo tray 31, and each of the unplaceable sizes is such a size that a sheet having this size is not to be placed on the Photo tray 31.

The INK 12*b*4 includes a plurality types (values) of inks to be used for printing, and each of the sheet sizes of the SHEET SIZE 12*b*1 corresponds to one of the types of ink. In the example illustrated in FIG. 2, information indicating that the ink stored in the pigment ink cartridge C1, i.e., the pigment ink, is to be used (indicated by "PIGMENT INK" in FIG. 2) as one example of information identifying use of the pigment ink is associated as the INK 12*b*4 with the eight sheet sizes of the SHEET SIZE 12*b*1 which correspond to the plain paper such as A4 and the three envelope sizes of the SHEET SIZE 12*b*1. On the other hand, information indicating that the ink stored in the dye ink cartridge C2, i.e., the dye ink, is to be used (indicated by "DYE INK" in FIG. 2) as one example of information identifying use of the dye ink is associated as the INK 12*b*4 with the three sheet sizes of the SHEET SIZE 12*b*1 which correspond to the glossy paper such as L. Accordingly, the sheet having each sheet size of the SHEET SIZE 12*b*1 can be classified as a corresponding one of a sheet for the pigment ink and a sheet for the dye ink on the basis of a value of the INK 12*b*4 which is associated with each sheet size of the SHEET SIZE 12*b*1.

The DUPLEX PRINTING 12*b*5 indicates whether a sheet can be used for the duplex printing or not. In the example illustrated in FIG. 2, information indicating that the duplex printing is possible (indicated by "POSSIBLE" in FIG. 2) as one example of a duplex-printing type is associated as the DUPLEX PRINTING 12*b*5 with the eight sheet sizes of the SHEET SIZE 12*b*1 such as A4 as one example of a plurality of duplex-printing sizes. On the other hand, information indicating that the duplex printing is impossible (indicated by "IMPOSSIBLE" in FIG. 2) as one example of a non-duplex-printing type is associated as the DUPLEX PRINTING 12*b*5 with the three sheet sizes of the SHEET SIZE 12*b*1 such as L and three envelope sizes of the SHEET SIZE 12*b*1 as one example of a plurality of non-duplex-printing sizes. Accordingly, the sheet having each sheet size of the SHEET SIZE 12*b*1 can be classified according to whether the duplex printing is possible or not, on the basis of a value of the DUPLEX PRINTING 12*b*5 which is associated with each sheet size of the SHEET SIZE 12*b*1.

Figure 3:
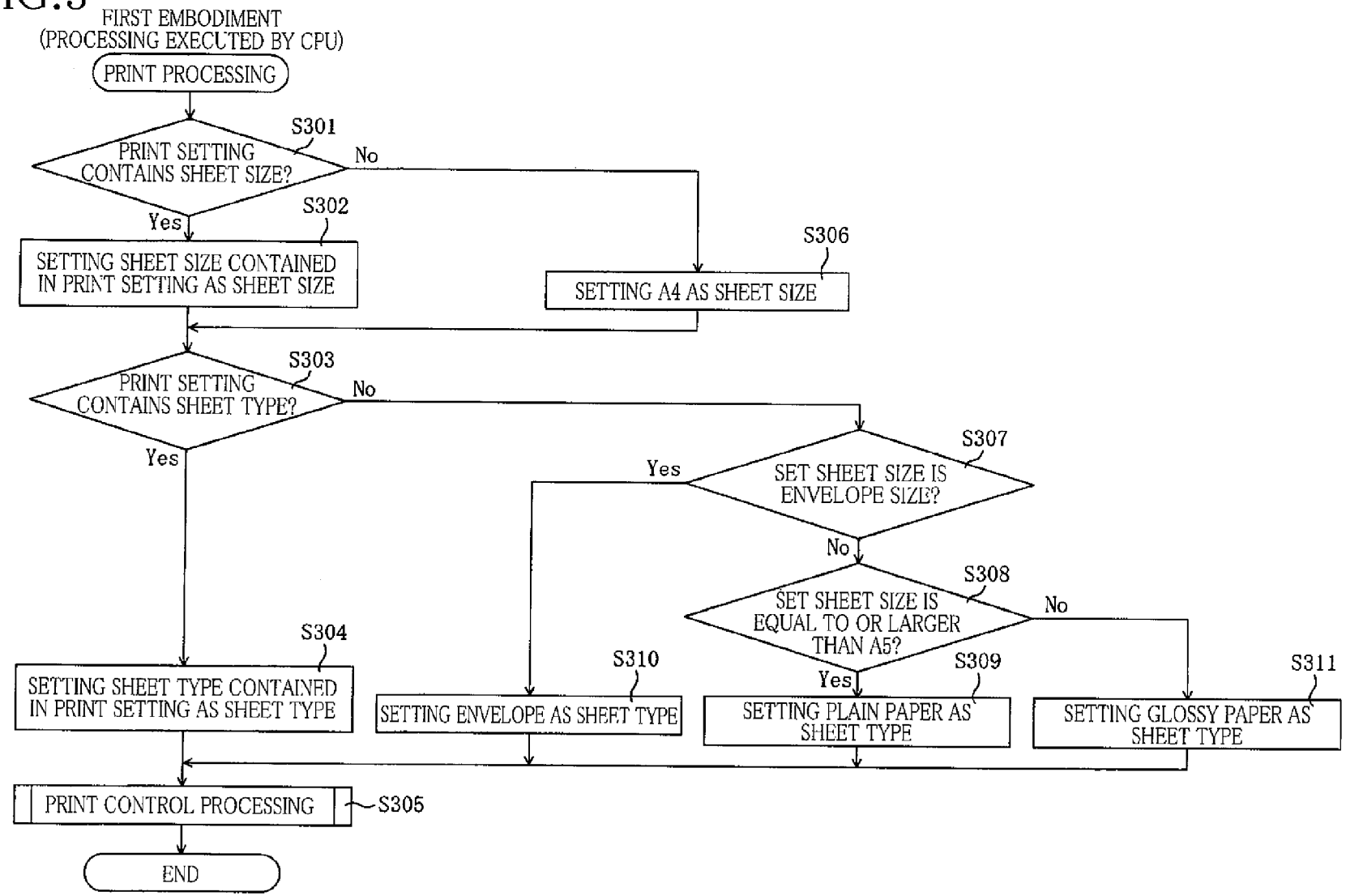
FIG. 3 is a flow chart illustrating a print processing.

There will be next explained, with reference to FIG. 3, a print processing executed by the CPU 11 of the MFP 10. This print processing is a processing designed to, under the specific conditions, resize the image based on the print data such that the image is fitted within the sheet to be used for printing, and print the resized image on the sheet, but under other conditions, restrict printing based on the print data in a case where a sheet size set by the print data received by the PC 100 differs from that of a sheet placed on one of the Photo tray 31 and the recording-sheet tray 32 to be used. This flow starts when the MFP 10 receives print data from the PC 100, that is, when a printing command is input to the PC 100. It is noted that the print data to be received by the MFP 10 contains print settings in the present embodiment.

When the CPU 11 determines at step S301 (hereinafter "step" is omitted where appropriate") that the print settings contain a sheet size (S301: Yes), the CPU 11 at S302 sets the sheet size contained in the print settings as a sheet size for printing, and this flow goes to S303. On the other hand, when the print settings do not contain the sheet size (S301: No), the CPU 11 at S306 sets the A4 size as the sheet size for printing, and this flow goes to S303. Since the sheet size for printing is automatically set at the A4 size when the print settings do not contain the sheet size, the sheet size for printing can be set even when the print settings do not contain the sheet size.

When the CPU 11 determines at S303 that the print settings contain the sheet type (S303: Yes), the CPU 11 at S304 sets the sheet type contained in the print settings as a sheet type for printing and at S305 executes a print control processing which will be described later with reference to FIGS. 4 and 5, and this flow ends. On the other hand, when the print settings do not contain the sheet type and when the set sheet size is one of the envelope sizes (S303: No, S307: Yes), the CPU 11 at S310 sets the envelope as the sheet type, and this flow goes to S305.

When the set sheet size is not any of the envelope sizes (S307: No) and when the set sheet size is equal to or larger than A5 (S308: Yes), the CPU 11 at S309 sets the plain paper as the sheet type, and this flow goes to S305. On the other hand, when the set sheet size is smaller than A5 (S308: No), the CPU 11 at S311 sets the glossy paper as the sheet type, and this flow goes to S305. It is noted that the CPU 11 executes the determinations at S307 and S308 by referring to the sheet-size table 12*b*. When the sheet type is set at S304, S309, S310, or S311, the printer 19 at printing uses print parameters related to the set sheet type.

Figure 4:
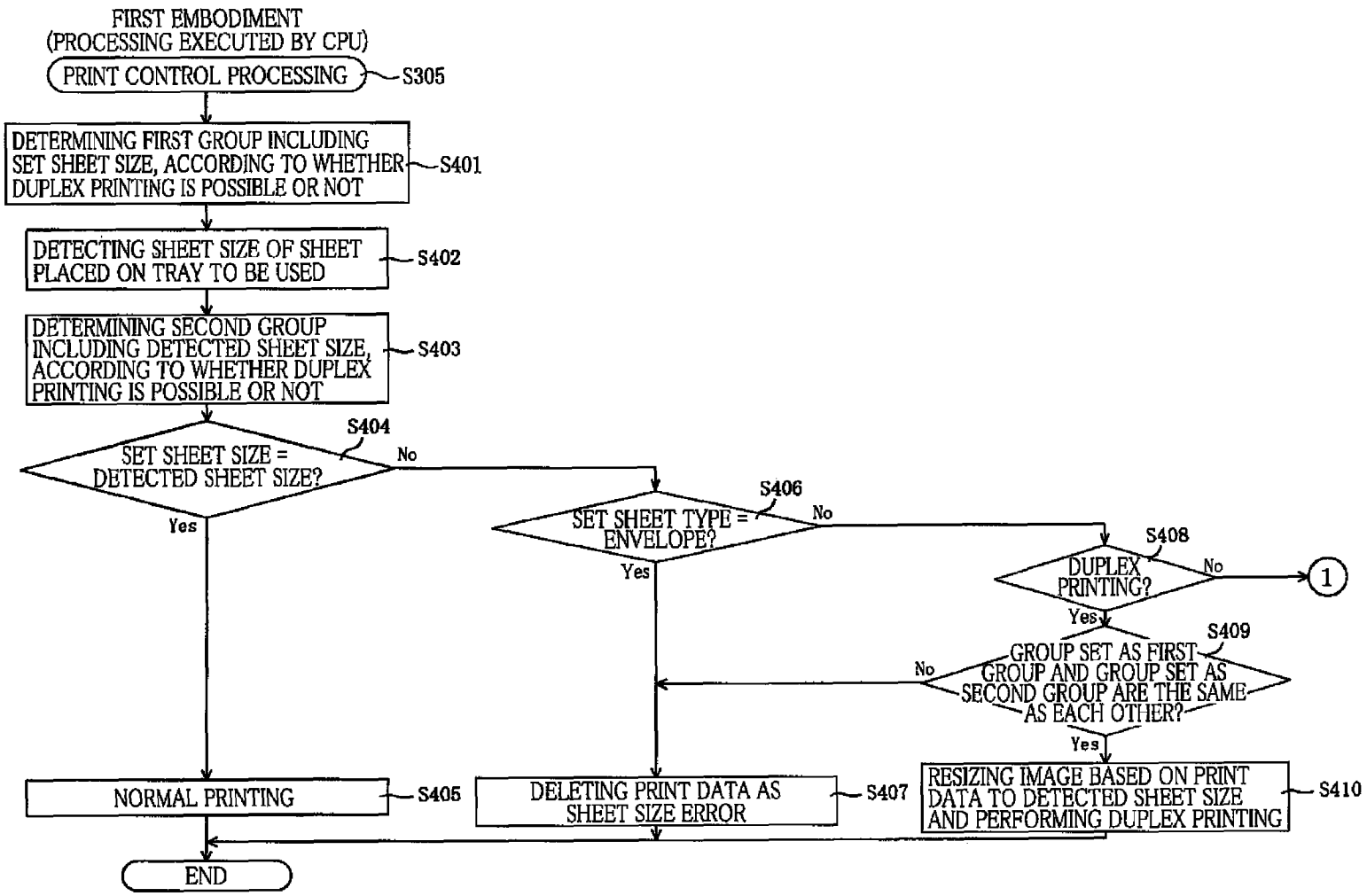
FIG. 4 is a flow chart illustrating a print control processing.

There will be next explained the above-described print control processing (at S305) with reference to FIGS. 4 and 5. This flow starts with S401 where the CPU 11 determines a first group including the sheet size set at S302 or S306, according to whether the duplex printing is possible or not. Specifically, the CPU 11 at S401 refers to the sheet-size table 12*b* to determine the first group on the basis of a value of the DUPLEX PRINTING 12*b*5 which corresponds to the set sheet size of the SHEET SIZE 12*b*1. Specifically, when the value of the DUPLEX PRINTING 12*b*5 which corresponds to the set sheet size of the SHEET SIZE 12*b*1 is indicative of the information indicating that the duplex printing is possible, the CPU 11 at S401 refers to the sheet-size table 12*b* to set a group of the sheet sizes suitable for the duplex printing as the first group. On the other hand, when the value of the DUPLEX PRINTING 12*b*5 is indicative of the information indicating that the duplex printing is impossible, the CPU 11 sets a group of the sheet sizes not suitable for the duplex printing as the first group.

The CPU 11 at S402 detects a sheet size of a sheet placed on one of the Photo tray 31 and the recording-sheet tray 32 to be used. Specifically, the CPU 11 at S402 detects the sheet size of the sheet placed on one of the trays 31, 32 to be used, on the basis of the signal output from the sheet-size sensor 31*a* or 32*a*. The CPU 11 at S403 determines a second group including the sheet size detected at S402, according to whether the duplex printing is possible or not. Specifically, the CPU 11 at S403 refers to the sheet-size table 12*b* to determine the second group on the basis of a value of the DUPLEX PRINTING 12*b*5 which corresponds to the detected sheet size of the SHEET SIZE 12*b*1. Specifically, when the value of the DUPLEX PRINTING 12*b*5 which corresponds to the detected sheet size of the SHEET SIZE 12*b*1 is indicative of the information indicating that the duplex printing is possible, the CPU 11 at S403 refers to the sheet-size table 12*b* to set the group of the sheet sizes suitable for the duplex printing as the second group. On the other hand, when the value of the DUPLEX PRINTING 12*b*5 is indicative of the information indicating that the duplex printing is impossible, the CPU 11 sets the group of the sheet sizes not suitable for the duplex printing as the second group.

When the CPU 11 at S404 determines that the sheet size set at S302 or S306 and the sheet size detected at S402 are the same as each other (S404: Yes), the CPU 11 at S405 controls the printer 19 to perform normal printing that is printing based on the received print data and print settings, and this flow ends.

When the set sheet size and the detected sheet size are not the same as each other (S404: No) and when the set sheet type is the envelope (S406: Yes), the CPU 11 at S407 determines the sheet size error and deletes the print data, and this flow ends. When the set sheet type is the envelope, the user wants to perform the printing on the envelope on the basis of the print data. Thus, the processing at S407 can prevent the printing from being performed on a sheet different from the envelope. That is, it is possible to prevent printing not intended by the user and production of useless printed sheets. On the other hand, when the set sheet size and the detected sheet size are not the same as each other (S404: No), when the set sheet type is not the envelope (S406: No), and when the print settings contain a setting for instructing the duplex printing (S408: Yes), the CPU 11 at S409 determines whether the group set at S401 as the first group and the group set at S403 as the second group are the same as each other or not. When the group set as the first group and the group set as the second group are not the same as each other (S409: No), this flow goes to S407.

On the other hand, when the group set as the first group and the group set as the second group are the same as each other (S409: Yes), the CPU 11 at S410 resizes the image based on the print data to the detected sheet size, i.e., the sheet size of the sheet placed on the one of the Photo tray 31 and the recording-sheet tray 32 to be used, and performs duplex printing, and this flow ends. Specifically, the CPU 11 calculates (i) a value by dividing a length of the detected sheet size by a length of the set sheet size and (ii) a value by dividing a width of the detected sheet size by a width of the set sheet size and determines a smaller one of these values (ratios) as a reduction ratio or an enlargement ratio. The CPU 11 then resizes the image based on the print data by reducing or enlarging the size of the image at the determined reduction ratio or enlargement ratio.

When the CPU 11 at S408 determines that the print settings do not contain the setting for instructing the duplex printing (S408: No), this flow goes to S501 in FIG. 5. The CPU 11 at S501 determines a first group including the set sheet size, according to whether a sheet type corresponding to the sheet size set based on the print data is the glossy paper or not. Specifically, when a value of the SHEET TYPE 12*b*2 which corresponds to the sheet size set at S302 or S306 is indicative of the glossy paper, the CPU 11 at S501 refers to the sheet-size table 12*b* to set a group of the sheet sizes corresponding to the glossy paper as the first group. On the other hand, when the value of the SHEET TYPE 12*b*2 is indicative of the plain paper or the envelope, the CPU 11 sets a group of the sheet sizes corresponding to sheet types other than the glossy paper as the first group.

The CPU 11 at S502 determines a second group including the detected sheet size, according to whether a sheet type corresponding to the sheet size detected at S402 is the glossy paper or not. Specifically, when a value of the SHEET TYPE 12*b*2 which corresponds to the sheet size detected at S402 is indicative of the glossy paper, the CPU 11 at S502 refers to the sheet-size table 12*b* to set the group of the sheet sizes corresponding to the glossy paper as the second group. On the other hand, when the value of the SHEET TYPE 12*b*2 is indicative of the plain paper or the envelope, the CPU 11 sets the group of the sheet sizes corresponding to the sheet types other than the glossy paper as the second group.

When the CPU 11 determines at S503 that the group set at S501 as the first group and the group set at S502 as the second group are the same as each other (S503: Yes), the CPU 11 at S504 resizes the image based on the print data to the detected sheet size, i.e., the sheet size of the sheet placed on the one of the Photo tray 31 and the recording-sheet tray 32 to be used, and performs printing of the resized image on the sheet, and this flow ends. It is noted that the CPU 11 at S504 performs the resizing in the same manner as in the resizing performed at S410.

On the other hand, when the group set as the first group and the group set as the second group are not the same as each other (S503: No) and when the first group set at S501 is the group of the sheet sizes corresponding to the glossy paper (S505: Yes), this flow goes to S504. That is, when the set sheet size belongs to the group of the sheet sizes corresponding to the glossy paper though the set sheet size and the detected sheet size are not the same as each other, the CPU 11 resizes the image based on the print data and performs printing regardless of whether a sheet to be used for the printing is the glossy paper or not. Since printing is performed according to the print parameters related to the set sheet type, printing with the dye ink is performed when the sheet type is the glossy paper.

When the first group is not the group of the sheet sizes corresponding to the glossy paper, that is, when the first group is the group of the sheet sizes corresponding to the sheet types other than the glossy paper (S505: No), and when the second group is the group of the sheet sizes corresponding to the sheet types other than the glossy paper (S506: No), this flow goes to S504. That is, when both of the set sheet size and the detected sheet size belong to the group of the sheet sizes corresponding to the sheet types other than the glossy paper, the CPU 11 resizes the image based on the print data and performs printing. Accordingly, when the sheet to be used for printing is of the sheet type other than the glossy paper, the printing is performed according to the print parameters related to the set sheet type regardless of whether the dye ink or the pigment ink is to be used. On the other hand, when the second group is the group of the sheet sizes corresponding to the glossy paper (S506: Yes) and when the set sheet type is the glossy paper (S507: Yes), the CPU 11 resizes the image based on the print data and performs printing on the glossy paper sheet with the dye ink.

When the set sheet type is not the glossy paper (S507: No) and when the MFP 10 is set to change print parameters for the set sheet type to print parameters for the glossy paper (S508: Yes), the CPU 11 at S509 sets the glossy paper as the sheet type for printing, and this flow goes to S504. When the glossy paper is set as the sheet type at S509, the CPU 11 changes the print parameters for the set sheet type to the print parameters for the glossy paper. Accordingly, when the set sheet size belongs to the group of the sheet sizes corresponding to the sheet types other than the glossy paper and when the detected sheet size belongs to the group of the sheet sizes corresponding to the glossy paper, the CPU 11 changes the print parameters to the print parameters corresponding to the detected sheet size, that is, the CPU 11 changes the print parameters for the set sheet type to the print parameters for the glossy paper, and resizes the image based on the print data and perform printing on the glossy paper sheet. Since the print parameters are changed to the print parameters for the sheet actually used, the CPU 11 performs printing suitable for the glossy paper sheet as the sheet actually used, that is, the CPU 11 performs the printing with the dye ink. It is noted that in the MFP 10 according to the present embodiment, when the set sheet size belongs to the group of the sheet sizes corresponding to the sheet types other than the glossy paper and when the detected sheet size belongs to the group of the sheet sizes corresponding to the glossy paper, a setting as to whether or not the MFP 10 is set to change the print parameters to print parameters for the glossy paper is switched as needed by a predetermined operation of the user on the MFP 10. Set values for this setting are stored in the flash memory 12.

On the other hand, when the CPU 11 at S508 determines that the MFP 10 is not set to change the print parameters for the set sheet type to the print parameters for the glossy paper (S508: No), the CPU 11 at S510 determines the sheet size error and deletes the print data. The CPU 11 at S511 controls the LCD 16 to display a reprint message, and this flow ends. The reprint message is a message prompting the user to command the printing again after the sheet is changed to the glossy paper sheet, for example. Accordingly, when the set sheet size belongs to the group of the sheet sizes corresponding to the sheet types other than the glossy paper and when the detected sheet size belongs to the group of the sheet sizes corresponding to the glossy paper, the printing is not performed on the glossy paper sheet according to the print parameters for the sheet of the sheet type other than the glossy paper.

In the MFP 10 according to the present embodiment, in a case where the sheet size set based on the print data and the sheet size detected by the sheet-size sensor 31*a* or 32*a* (i.e., the sheet size of the sheet to be used for printing) are different from each other, when the type corresponding to the set sheet size and the type corresponding to the detected sheet size are the same as each other, the printing is performed using the resized image. On the other hand, in the case where the sheet size set based on the print data and the detected sheet size are different from each other, when the type corresponding to the set sheet size and the type corresponding to the detected sheet size are different from each other, the printing based on the print data is restricted. This restriction includes: a restriction in which the printing based on the print data is not performed; and a restriction in which the print parameters are changed. These restrictions can prevent an occurrence of problems which may be caused by the printing based on the print data on a sheet whose type differs from the type corresponding to the sheet size set based on the print data.

Specifically, in the MFP 10 according to the present embodiment, when the type corresponding to the sheet size set based on the print data is the sheet type other than the glossy paper and when the type corresponding to the detected sheet size is the glossy paper, printing is not performed or performed according to the print parameters for the glossy paper which are changed from the original print parameters. These restrictions prohibit printing from being performed on the glossy paper sheet according to the print parameters for the sheet of the sheet type other than the glossy paper. That is, the printing is not performed on the glossy paper sheet with the pigment ink. This makes it possible to prevent a printed material from getting soiled by the printing on the glossy paper sheet with the pigment ink which has poor fixability to the glossy paper. As a result, it is possible to prevent printing not intended by the user, e.g., printing easily soiling the printed material.

Also, in the MFP 10 according to the present embodiment, even in the case where the sheet size set based on the print data and the detected sheet size are different from each other, when the type corresponding to the set sheet size is the glossy paper, the printing is performed using the resized image without any of the above-described restrictions. Even in a case where printing is performed on the plain paper sheet with the dye ink, fixability of the ink to the sheet is sufficient, resulting in a lower possibility of soiling the printed material with the dye ink. Thus, a desired printed material can be obtained without reprinting.

Also, in the MFP 10 according to the present embodiment, also when the type corresponding to the sheet size set based on the print data is the sheet suitable for the duplex printing and when the type corresponding to the detected sheet size is the sheet not suitable for the duplex printing, the printing based on the print data is restricted. This prevents the duplex printing from being performed on the sheet not suitable for the duplex printing, preventing an occurrence of problems such as errors and useless consumption of sheets.

There will be explained a second embodiment with reference to FIG. 6. In the above-described first embodiment, the CPU 11 determines whether the type corresponding to the sheet size set based on the print data and the type corresponding to the detected sheet size are the same as each other or not, on the basis of whether the sheet for printing is the glossy paper sheet for the dye ink or the sheet for the pigment ink (i.e., the sheet of the sheet type other than the glossy paper). In the present embodiment, this determination is performed on the basis of whether the tray to be used is the Photo tray 31 or not. It is noted that the same reference numerals as used in the first embodiment are used to designate the corresponding elements of the second embodiment, and an explanation of which is dispensed with.

FIG. 6 is a flow chart partly illustrating a print control processing in the second embodiment. The print control processing in the second embodiment is a processing in which the processings illustrated in the flow chart in FIG. 5 in the print control processing (see FIGS. 4 and 5) in the first embodiment are replaced with processings illustrated in the flow chart in FIG. 6. Thus, in the print control processing in the second embodiment, when the CPU 11 determines at S408 in FIG. 4 that the print settings do not contain the setting for instructing the duplex printing (S408: No), the flow goes to S601 in FIG. 6. It is noted that the processings in FIG. 6 are executed by the CPU 11 according to the control program 12*a* as in the first embodiment.

The CPU 11 at S601 determines a first group including the set sheet size, according to whether the sheet having the sheet size set based on the print data is to be placed on the Photo tray 31 or not. Specifically, when a value of the TRAY 12*b*3 which corresponds to the sheet size set at S302 or S306 is indicative of information indicating that the sheet having the set sheet size is to be placed on the Photo tray 31, the CPU 11 at S601 refers to the sheet-size table 12*b* to set a group of the sheet sizes corresponding to the Photo tray 31 (i.e., a group of the sheet sizes of the sheets placeable on the Photo tray 31*a*) as the first group. On the other hand, when the value of the TRAY 12*b*3 is indicative of information indicating that the sheet having the set sheet size is to be placed on the recording-sheet tray 32, the CPU 11 sets a group of the sheet sizes not corresponding to the Photo tray 31 (i.e., a group of the sheet sizes of the sheets not placeable on the Photo tray 31*a*) as the first group.

At S602, the CPU 11 determines a second group including the detected sheet size, according to whether the sheet having the sheet size detected at S402 can be placed on the Photo tray 31 or not. Specifically, when a value of the TRAY 12*b*3 which corresponds to the sheet size detected at S402 is indicative of information indicating that the sheet having the detected sheet size is to be placed on the Photo tray 31, the CPU 11 at S602 refers to the sheet-size table 12*b* to set the group of the sheet sizes corresponding to the Photo tray 31 as the second group. On the other hand, when the value of the TRAY 12*b*3 is indicative of information indicating that the sheet having the detected sheet size is to be placed on the recording-sheet tray 32, the CPU 11 sets the group of the sheet sizes not corresponding to the Photo tray 31 as the second group.

When the CPU 11 at S603 determines that the group set at S601 as the first group and the group set at S602 as the second group are the same as each other (S603: Yes), the CPU 11 at S504 resizes the image based on the print data to the detected sheet size and performs printing, and this flow ends. On the other hand, when the group set as the first group and the group set as the second group are not the same as each other (S603: No) and when the group set at S601 as the first group is the group of the sheet sizes corresponding to the Photo tray 31 (S604: Yes), this flow goes to S504. That is, when the set sheet size belongs to the group of the sheet sizes corresponding to the Photo tray 31 though the set sheet size and the detected sheet size are not the same as each other, the CPU 11 resizes the image based on the print data and performs printing. Each of the sheets placeable on the Photo tray 31 is a relatively small sheet and is the glossy paper in most cases. Thus, when the group set at S601 as the first group is the group of the sheet sizes corresponding to the Photo tray 31, i.e., the group of the sheet sizes corresponding to the glossy paper, the CPU 11 resizes the image based on the print data and performs printing with the dye ink regardless of whether the sheet to be used for printing is placeable on the Photo tray 31 or not, i.e., regardless of whether the sheet to be used for printing is the glossy paper or not.

When the first group is the group of the sheet sizes not corresponding to the Photo tray 31 (S604: No) and when the second group is the group of the sheet sizes not corresponding to the Photo tray 31 (S605: No), this flow goes to S504. That is, when both of the set sheet size and the detected sheet size belong to the group of the sheet sizes not corresponding to the Photo tray 31, the CPU 11 resizes the image based on the print data and performs printing. Thus, when the sheet to be used for printing is the sheet not placeable on the Photo tray 31, printing is performed according to the print parameters related to the set sheet type regardless of whether the dye ink or the pigment ink is to be used.

When the second group is the group of the sheet sizes corresponding to the Photo tray 31 (S605: Yes) and when the set sheet type is the glossy paper (S507: Yes), the CPU 11 at S504 resizes the image based on the print data and performs printing on the glossy paper sheet with the dye ink. When the set sheet type is not the glossy paper (S507: No) and when the MFP 10 is set to change the print parameters for the set sheet type to the print parameters for the glossy paper (S508: Yes), the CPU 11 at S509 sets the glossy paper as the sheet type for printing, and this flow goes to S504. When the set sheet size belongs to the group of the sheet sizes not corresponding to the Photo tray 31 and when the detected sheet size belongs to the group of the sheet sizes corresponding to the Photo tray 31, the CPU 11 changes the print parameters to the print parameters corresponding to the detected sheet size, i.e., the print parameters corresponding to the sheet (i.e., the glossy paper) placed on the Photo tray 31, and then the CPU 11 resizes the image based on the print data and performs printing on the glossy paper sheet supplied from the Photo tray 31.

On the other hand, when the CPU 11 at S508 determines that the MFP 10 is not set to change the print parameters for the set sheet type to the print parameters for the glossy paper (S508: No), the CPU 11 at S510 determines the sheet size error and deletes the print data. The CPU 11 at S511 controls the LCD 16 to display the reprint message, and this flow ends. Thus, when the set sheet size belongs to the group of the sheet sizes not corresponding to the Photo tray 31 and when the detected sheet size belongs to the group of the sheet sizes corresponding to the Photo tray 31, the printing is not performed on the glossy paper sheet placeable on the Photo tray 31, according to the print parameters for the sheet of the sheet type other than the glossy paper. That is, the printing is not performed on the glossy paper sheet with the pigment ink.

In the second embodiment, when the sheet size set based on the print data is not suitable for the Photo tray 31 and when the detected sheet size is suitable for the Photo tray 31, the printing is not performed or performed according to the print parameters for the glossy paper which are changed from the original print parameters. As in the above-described first embodiment, these restrictions prevent the printing from being performed on the glossy paper sheet according to the print parameters for the sheet of the sheet type other than the glossy paper, making it possible to prevent the printing not intended by the user, e.g., the printing easily soiling the printed material. Also, in the MFP 10, even in the case where the sheet size set based on the print data and the detected sheet size are different from each other, when the set sheet size is suitable for the Photo tray 31, the printing is performed using the resized image without any of the above-described restrictions. As in the above-described first embodiment, accordingly, there is a lower possibility of soiling the printed material with the dye ink by printing on the plain paper sheet with the dye ink. Thus, a desired printed material can be obtained without reprinting.

In the above-described embodiments, the wireless communicator 22 is one example of a receiver. The printer 19 is one example of a printing device. The Photo tray 31 is one example of a tray and a first tray. The recording-sheet tray 32 is one example of the tray and a second tray. The flash memory 12 is one example of a storage device. The CPU 11 is one example of a controller. The pigment ink cartridge C1 is one example of a first ink cartridge. The dye ink cartridge C2 is one example of a second ink cartridge. The PC 100 is one example of an information processor. The CPU 11 can be considered to include an identifier that executes the processings at S301, S302, S401, and S501, for example. The CPU 11 can also be considered to include a detector that executes the processing at S402, for example. The CPU 11 can also be considered to include a determiner that executes the processings at S409, S503, and S603, for example. The CPU 11 can also be considered to include a printing controller that executes the processing at S504, for example. The CPU 11 can also be considered to include a parameter changer that executes the processing at S509, for example. Also, each of the SHEET TYPE 12*b*2, the TRAY 12*b*3, the INK 12*b*4, and the DUPLEX PRINTING 12*b*5 corresponding to the sheet size set at S302 or S306 is one example of an identified type, and each of the SHEET TYPE 12*b*2, the TRAY 12*b*3, the INK 12*b*4, and the DUPLEX PRINTING 12*b*5 corresponding to the sheet size detected at S402 is one example of a detected type. Also, each of the information indicating that the sheet type is the plain paper, the information indicating that the sheet type is the envelope, the information indicating that the sheet is to be placed on the recording-sheet tray 32, the information indicating that the pigment ink is to be used, the information indicating that the duplex printing is possible is one example of a first type. Each of the information indicating that the sheet type is the glossy paper, the information indicating that the sheet is to be placed on the Photo tray 31, the information indicating that the dye ink is to be used, and the information indicating that the duplex printing is impossible is one example of a second type.

While the embodiments of the present invention have been described above, it is to be understood that the invention is not limited to the details of the illustrated embodiments, but may be embodied with various changes and modifications, which may occur to those skilled in the art, without departing from the spirit and scope of the invention. For example, while the present invention is applied to the MFP 10 having functions other than the printing function as one example of the printing apparatus in the above-described embodiments, the present invention may be applied to a printer having only the printing function as the printing apparatus. Also, while the PC 100 is one example of the information processor in the above-described embodiments, mobile terminals such as a smartphone, a tablet terminal, and a mobile phone may be used as the information processor.

While the MFP 10 receives the print data containing the print settings and executes the processings in the above-described embodiments, the MFP 10 may receive the print data and the print settings separately and execute the processings.

In the above-described embodiments, in the case where the first group including the set sheet size and the second group including the detected sheet size are different from each other, when the MFP 10 is set to change the print parameters for the set sheet type to the print parameters for the glossy paper, the CPU 11 changes the print parameters to those for the glossy paper and performs printing. Nevertheless, where the first group and the second group are different from each other, the print data is deleted as the sheet size error without making any changes to the print parameters.

In the above-described second embodiments, the CPU 11 determines the first group including the set sheet size according to whether the sheet having the sheet size set based on the print data can be placed on the Photo tray 31 or not, and determines the second group including the detected sheet size according to whether the sheet having the detected sheet size can be placed on the Photo tray 31 or not. Instead of this configuration, this MFP 10 may be configured such that the CPU 11 determines the first group according to whether the set sheet size is suitable for the dye ink or not, and determines the second group according to whether the detected sheet size is suitable for the dye ink or not. In this configuration, the CPU 11 at S601 refers to the sheet-size table 12*b*, and when a value of the INK 12*b*4 which corresponds to the set sheet size is indicative of the information indicating that the ink stored in the dye ink cartridge C2 is to be used, the CPU 11 sets the group of the sheet sizes corresponding to the dye ink as the first group including the set sheet size. The CPU 11 may determine the second group in the same manner, that is, the CPU 11 may refer to the sheet-size table 12*b* and determine the second group on the basis of the detected sheet size. In addition, the CPU 11 may at S604 determine whether the first group is the group of the sheet sizes corresponding to the dye ink or not and at S605 determine whether the second group is the group of the sheet sizes corresponding to the dye ink or not.

In the above-described embodiments, the CPU 11 sets the sheet size once for one job on the basis of a first page and executes the print control processing (S305) on the basis of the set sheet size. Nevertheless, in a case where one job contains print data representative of a plurality of pages, and the one job is for printing on sheets of different sheet sizes, the CPU 11 may set each of these sheet sizes for a corresponding one of the pages and execute the print control processing (S305) for each of the pages on the basis of the corresponding sheet size.

While the sheets having the respective sheet sizes of the SHEET SIZE 12*b*1 are classified into two or three types in the sheet-size table 12*b* in the above-described embodiments, the number of types may be equal to or greater than two. In a case where the sheets are classified into many types, and the first group and the second group are different from each other not in all the types but in specific two of the types, the CPU 11 may perform resizing and printing when the first group is one type and the second group is the other type, and may restrict printing when the second group is the one type and the first group is the other type.

While the sheet size of the sheet placed on the Photo tray 31 or the recording-sheet tray 32 is obtained on the basis of the signal output from the sheet-size sensor 31*a* or 32*a* in the above-described embodiments, a method for obtaining the sheet size is not limited to this method. For example, this MFP 10 may use a media sensor provided on a lower face (i.e., a face which faces the sheet) of the print head, not shown, of the printer 19 and capable of optically detecting a width of the sheet in a direction perpendicular to the conveying direction. Specifically, the MFP 10 may be configured such that the sheet placed on the Photo tray 31 or the recording-sheet tray 32 is conveyed to a position where the media sensor can sense the sheet, and the print head is reciprocated to allow the media sensor to detect the width of the sheet, based on which the sheet size is obtained.

What is claimed is:

1. A printing apparatus, comprising:

a receiver configured to receive print data from an information processor;

a printing device configured to conduct printing on a sheet based on the print data received by the receiver;

a tray configured to hold the sheet;

a storage device configured to store each of a plurality of sheet sizes and a corresponding one type of a plurality of types in association with each other, the plurality of types comprising an identified type and a detected type; and a controller comprising:

an identifier configured to identify, based on the print data received by the receiver, a sheet size of a sheet on which the printing device is to conduct the printing based on the print data;

a detector configured to detect a sheet size of a sheet placed on the tray;

a determiner configured to, when the sheet size identified by the identifier and the sheet size detected by the detector differ from each other, determine whether the identified type associated with the sheet size identified by the identifier and the detected type associated with the sheet size detected by the detector are identical to each other; and a printing controller configured to, when the determiner determines that the identified type and the detected type are identical to each other, one of reduce and enlarge a size of an image based on the print data received by the receiver, based on the sheet size detected by the detector, and control the printing device to conduct printing of the image whose size has been one of reduced and enlarged by the printing controller, the printing controller being configured to, when the determiner determines that the identified type and the detected type are different from each other, restrict conduct of the printing by the printing device based on the print data received by the receiver.

2. The printing apparatus according to claim 1, wherein the storage device is configured to store each of the plurality of sheet sizes and a corresponding one of information identifying use of pigment ink and information identifying use of dye ink as the corresponding one type, in association with each other, wherein the identifier is configured to identify, in addition to the sheet size, the corresponding one type stored in the storage device in association with the sheet size, and wherein the printing device is configured to conduct the printing with one of the pigment ink and the dye ink based on the corresponding one type identified by the identifier.

3. The printing apparatus according to claim 2, wherein the printing controller is configured to, when the determiner determines that the identified type and the detected type are different from each other and when the corresponding one type identified by the identifier is the information identifying the use of the dye ink, one of reduce and enlarge the size of the image based on the print data received by the receiver, based on the sheet size detected by the detector, and control the printing device to conduct the printing of the image whose size has been one of reduced and enlarged by the printing controller, without restricting the conduct of the printing.

4. The printing apparatus according to claim 2, wherein the printing controller is configured not to, when the determiner determines that the identified type and the detected type are different from each other and when the corresponding one type identified by the identifier is the information identifying the use of the pigment ink, conduct the printing by the printing device based on the print data received by the receiver.

5. The printing apparatus according to claim 1, further comprising a first tray and a second tray each as the tray, wherein a plurality of sheets respectively having a plurality of first sheet sizes are placeable on the first tray, and a plurality of sheets respectively having a plurality of second sheet sizes are not placeable on the first tray, and wherein the plurality of sheets respectively having the plurality of first sheet sizes and the plurality of sheets respectively having the plurality of second sheet sizes are placeable on the second tray, wherein the plurality of types comprise a first placement type and a second placement type different from the first placement type, wherein the storage device is configured to store each of the plurality of first sizes and the first placement type in association with each other and store each of the plurality of second sizes and the second placement type in association with each other, wherein a sheet of the first placement type is to be placed on the first tray, and a sheet of the second placement type is to be placed on the second tray, wherein the identifier is configured to, in addition to the sheet size, one of the first placement type and the second placement type which one is stored in the storage device in association with the sheet size, and wherein the printing device is configured to conduct the printing on one of a sheet placed on the first tray and a sheet placed on the second tray based on the one of the first placement type and the second placement type which has been identified by the identifier.

6. The printing apparatus according to claim 5, wherein the printing controller is configured to, when the determiner determines that the identified type and the detected type are different from each other and when the first placement type is identified by the identifier, one of reduce and enlarge the size of the image based on the print data received by the receiver, based on the sheet size detected by the detector, and control the printing device to conduct the printing of the image whose size has been one of reduced and enlarged by the printing controller, without restricting the conduct of the printing.

7. The printing apparatus according to claim 5, wherein the printing controller is configured not to, when the determiner determines that the identified type and the detected type are different from each other and when the second placement type is identified by the identifier, conduct the printing by the printing device based on the print data received by the receiver.

8. The printing apparatus according to claim 1, wherein the plurality of sheet sizes comprise: a plurality of duplex-printing sizes different from each other and each allowing duplex printing; and a plurality of non-duplex-printing sizes different from each other and each prohibiting the duplex printing, wherein the plurality of types comprise a duplex-printing type and a non-duplex-printing type, wherein the storage device is configured to store each of the plurality of duplex-printing sizes and the duplex-printing type in association with each other and store each of the plurality of non-duplex-printing sizes and the non-duplex-printing type in association with each other, wherein the identifier is configured to identify, in addition to the sheet size, one of the duplex-printing type and the non-duplex-printing type which one is stored in the storage device in association with the sheet size, wherein the printing controller is configured to, when the determiner determines that the identified type and the detected type are identical to each other, one of reduce and enlarge a size of at least one image based on the print data received by the receiver, based on the sheet size detected by the detector, and control the printing device to conduct the printing of the at least one image whose size has been one of reduced and enlarged by the printing controller, and wherein the printing controller is configured to, when the determiner determines that the identified type and the detected type are different from each other, restrict the conduct of the printing by the printing device based on the print data received by the receiver.

9. The printing apparatus according to claim 1, wherein the controller further comprises a parameter changer configured to, when the determiner determines that the identified type and the detected type are different from each other, change a print parameter for the identified type to a print parameter for the detected type, and wherein the printing controller is configured to, when the print parameter for the identified type is changed by the parameter changer, one of reduce and enlarge the size of the image based on the print data received by the receiver, based on the sheet size detected by the detector, and control the printing device to conduct the printing of the image whose size has been one of reduced and enlarged by the printing controller, without restricting the conduct of the printing.

10. The printing apparatus according to claim 1, wherein the plurality of types comprise a first type and a second type different from the first type, wherein the printing controller is configured to restrict the conduct of the printing when the determiner determines that the identified type and the detected type are different from each other, when the identified type is the first type, and when the detected type is the second type, and wherein the printing controller is configured to, when the determiner determines that the identified type and the detected type are different from each other, when the identified type is the second type, and when the detected type is the first type, one of reduce and enlarge the size of the image based on the print data received by the receiver, based on the sheet size detected by the detector, and control the printing device to conduct the printing of the image whose size has been one of reduced and enlarged by the printing controller, without restricting the conduct of the printing.

11. The printing apparatus according to claim 10, wherein the first type is information identifying use of pigment ink, and the second type is information identifying use of dye ink, wherein the storage device stores each of the plurality of sheet sizes and a corresponding one of the first type and the second type in association with each other, wherein the identifier is configured to identify, in addition to the sheet size, one of the first type and the second type which one is stored in the storage device in association with the sheet size, and wherein the printing device is configured to conduct the printing with one of the pigment ink and the dye ink based on the one of the first type and the second type which has been identified by the identifier.

12. The printing apparatus according to claim 10, further comprising a first tray and a second tray each as the tray, wherein a plurality of sheets respectively having a plurality of first sheet sizes are placeable on the first tray, and a plurality of sheets respectively having a plurality of second sheet sizes are not placeable on the first tray, and wherein the plurality of sheets respectively having the plurality of first sheet sizes and the plurality of sheets respectively having the plurality of second sheet sizes are placeable on the second tray, wherein the storage device is configured to store each of the plurality of first sizes and the first type in association with each other and store each of the plurality of second sizes and the second type in association with each other, wherein the identifier is configured to identify, in addition to the sheet size, one of the first type and the second type which one is stored in the storage device in association with the sheet size, and wherein the printing device is configured to conduct the printing on one of a sheet placed on the first tray and a sheet placed on the second tray based on the one of the first type and the second type which has been identified by the identifier.

13. The printing apparatus according to claim 1, wherein the printing controller is configured to, when the sheet size identified by the identifier and the sheet size detected by the detector are not identical to each other and when the sheet size identified by the identifier is a size corresponding to an envelope, restrict the conduct of the printing by the printing device based on the print data received by the receiver.

14. The printing apparatus according to claim 1, wherein the determiner is configured to, when print data received by the receiver and corresponding to one job is representative of printing for a plurality of pages and when the sheet size identified by the identifier comprises a plurality of sizes, determine whether the identified type and the detected type are identical to each other for each of the plurality of pages.

15. The printing apparatus according to claim 1, wherein the identifier is configured to identify a set specific size as the sheet size when the print data received by the receiver does not contain information about a sheet size.

16. A printing apparatus, comprising:

a receiver configured to receive print data from an information processor;

a printing device configured to conduct printing on a sheet based on the print data received by the receiver;

a tray configured to hold the sheet;

a storage device configured to store each of a plurality of sheet sizes and a corresponding one type of a plurality of types in association with each other, the plurality of types comprising an identified type, a detected type, a first type and a second type different from the first type; and a controller comprising:

an identifier configured to identify, based on the print data received by the receiver, a sheet size of a sheet on which the printing device is to conduct the printing based on the print data;

a detector configured to detect a sheet size of a sheet placed on the tray;

a determiner configured to, when the sheet size identified by the identifier and the sheet size detected by the detector differ from each other, determine whether the identified type associated with the sheet size identified by the identifier and the detected type associated with the sheet size detected by the detector are identical to each other; and a printing controller configured to, when the determiner determines that the identified type and the detected type are different from each other, when the identified type is the second type, and when the detected type is the first type, one of reduce and enlarge a size of an image based on the print data received by the receiver, based on the sheet size detected by the detector, and control the printing device to conduct printing of the image whose size has been one of reduced and enlarged by the printing controller, the printing controller being configured to, when the determiner determines that the identified type and the detected type are different from each other, when the identified type is the first type, and when the detected type is the second type, restrict conduct of the printing by the printing device based on the print data received by the receiver.

* * * * *